US008185034B2

(12) United States Patent
Akaike

(10) Patent No.: US 8,185,034 B2
(45) Date of Patent: May 22, 2012

(54) STORAGE CONTAINER, POWDER PROCESSING DEVICE, AND IMAGE FORMING APPARATUS USING THE SAME

(75) Inventor: Takashi Akaike, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 34 days.

(21) Appl. No.: 12/539,002

(22) Filed: Aug. 11, 2009

(65) Prior Publication Data

US 2010/0119271 A1 May 13, 2010

(30) Foreign Application Priority Data

Nov. 7, 2008 (JP) ..... P2008-287154

(51) Int. Cl.
*G03G 21/12* (2006.01)

(52) U.S. Cl. ..... 399/360; 399/110

(58) Field of Classification Search ..... 399/123, 399/343, 349, 358–360
See application file for complete search history.

(56) References Cited

U.S. PATENT DOCUMENTS 5,537,191 A * 7/1996 Aruga et al. ..... 399/254
5,634,172 A 5/1997 Manabe
6,167,211 A * 12/2000 Oogi et al. ..... 399/53
2005/0207792 A1* 9/2005 Ikeda et al. ..... 399/254
2005/0220515 A1* 10/2005 Wakana ..... 399/358
2006/0269305 A1* 11/2006 Murakami et al. ..... 399/35

FOREIGN PATENT DOCUMENTS

JP 4-060671 2/1992
JP 5-45732 U 6/1993
JP 8-241020 9/1996

* cited by examiner

*Primary Examiner* — David Porta
*Assistant Examiner* — Benjamin Schmitt
(74) *Attorney, Agent, or Firm* — Morgan, Lewis & Bockius LLP

(57) ABSTRACT

A storage container includes: a container body that is detachably disposed on a predetermined container receiver, wherein powder to be supplied or recovered powder is stored in the container body; and a powder driving transmitting mechanism that is disposed in the container body, and that transmits a transportable driving force to the powder to be supplied or recovered powder, and, when the container body is mounted on the container receiver, the powder driving transmitting mechanism couples a powder conveying mechanism that is disposed on a side of the container receiver, and that, outside the container body, conveys the powder to be supplied or recovered powder, with a driving mechanism that is disposed on a side of the container receiver, and that drives the powder conveying mechanism.

12 Claims, 15 Drawing Sheets

STORAGE CONTAINER, POWDER PROCESSING DEVICE, AND IMAGE FORMING APPARATUS USING THE SAME

CROSS-REFERENCE TO RELATED APPLICATIONS

This application is based on and claims priority under 35 USC 119 from Japanese Patent Application No. 2008-287154 filed on Nov. 7, 2008.

BACKGROUND

Technical Field

The present invention relates to a storage container, a powder processing device, and an image forming apparatus using the same.

SUMMARY

According to an aspect of the invention, there is provided a storage container including: a container body which is detachably disposed on a predetermined container receiver, and in which powder to be supplied or recovered powder is stored; and a powder driving transmitting mechanism which is disposed in the container body, and which transmits a transportable driving force to the powder to be supplied or recovered powder, wherein, when the container body is mounted on the container receiver, the powder driving transmitting mechanism couples a powder conveying mechanism which is disposed on a side of the container receiver, and which, outside the container body, conveys the powder to be supplied or recovered powder, with a driving mechanism which is disposed on a side of the container receiver, and which drives the powder conveying mechanism.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1 . . . container receiver, 2 . . . storage container, 3 . . . container body, 4 . . . powder driving transmitting mechanism, 4*a* . . . conveying member, 5 . . . powder conveying mechanism, 5*a* . . . conveying pipe, 5*b* . . . conveying member, 5*c* . . . opening/closing lid, 6 . . . driving mechanism, 6*a* . . . driving source, 6*b* . . . contacting/separating portion, 10, 10' . . . powder processing device, 11 . . . image forming unit, 12 . . . cleaning unit, T . . . powder

DETAILED DESCRIPTION

Summary of Embodiments

First, embodiments of the storage container and powder processing device to which the invention is applied will be summarily described.

<Storage Container>

The storage container used in the embodiment includes both a container which stores powder to be supplied, and that which stores recovered powder.

Figure 1A:
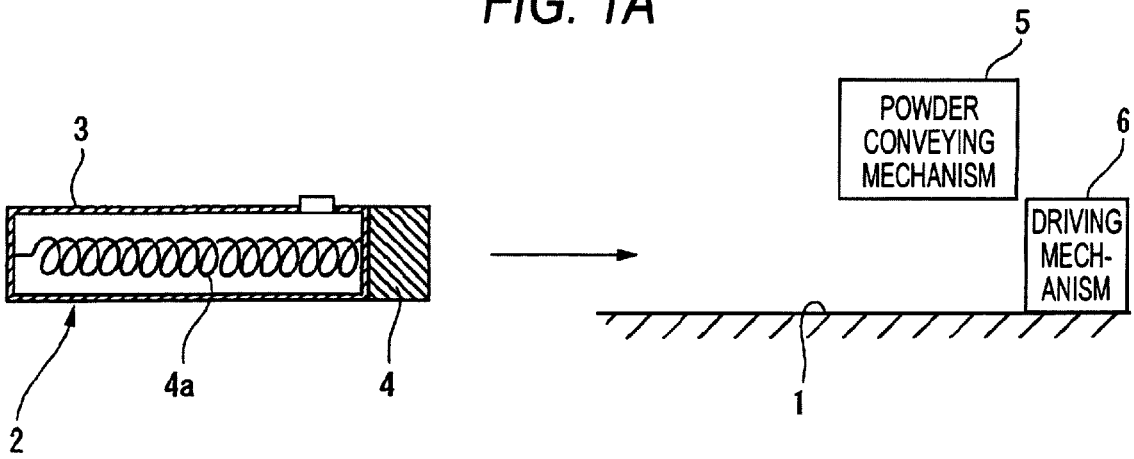
FIG. 1A is a diagram schematically showing an embodiment of a storage container to which the invention is applied, and a state where the storage container is not mounted on a container receiver.
Figure 1B:
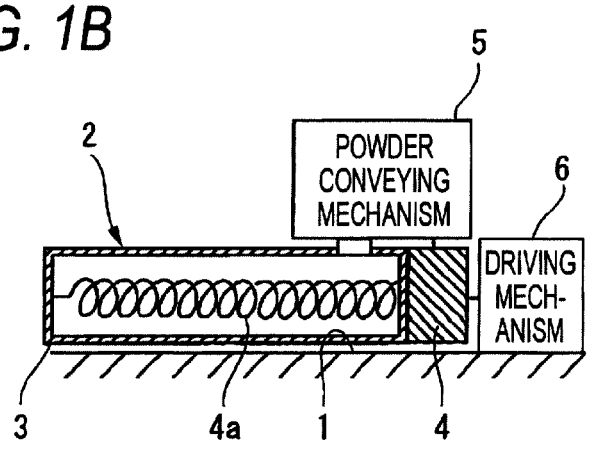
FIG. 1B is a diagram schematically showing a state where the storage container is mounted on the container receiver.

Specifically, in the embodiment, as shown in FIGS. 1A and 1B, the storage container 2 includes: a container body 3 which is detachably disposed on a predetermined container receiver 1, and in which powder to be supplied or recovered powder is stored; and a powder driving transmitting mechanism 4 which is disposed in the container body 3, and which transmits a transportable driving force to the powder to be supplied or recovered powder. When the container body 3 is mounted on the container receiver 1, the powder driving transmitting mechanism 4 couples a powder conveying mechanism 5 which is disposed on the side of the container receiver 1, and which, outside the container body 3, conveys the powder to be supplied or recovered powder, with a driving mechanism 6 which is disposed on the side of the container receiver 1, and which drives the powder conveying mechanism 5.

As a typical mode of "powder" in this specification, there is an image forming material such as a toner to be used in an image forming apparatus. The powder is not restricted to this.

In the mode, the shape of the container body 3 is not particularly restricted as far as it can internally store powder.

The powder driving transmitting mechanism 4 is requested to be disposed in the container body 3, and transmit a transportable driving force to the powder to be supplied or recovered powder. In the specification, "powder to be supplied or recovered powder" chiefly means powder which is outside the container body 3, but preferably means also powder which is inside the container body 3. As a mode where "powder to be supplied or recovered powder" is inside the container body 3, there is a mode where the powder driving transmitting mechanism 4 has a conveying member 4*a* capable to convey powder inside the container body 3, and drives the conveying member 4*a* by the driving force transmitted from the driving mechanism 6.

In the embodiment, when the container body 2 is not mounted on the container receiver 1 as shown in FIG. 1A, the powder driving transmitting mechanism 4 does not couple the powder conveying mechanism 5 with the driving mechanism 6, and, when the container body 2 is mounted on the container receiver 1 as shown in FIG. 1B, the powder driving transmitting mechanism couples the powder conveying mechanism 5 with the driving mechanism 6. In the embodiment, therefore, the powder conveying mechanism 5 is not driven by the driving mechanism 6 unless the container body 2 is mounted on the container receiver 1.

<Powder Processing Device>

The powder processing device which is used in the embodiment processes a wide variety of powder materials. In the specification, "process" means, for example, a process of recovering powder, and that of supplying process.

Figure 2:
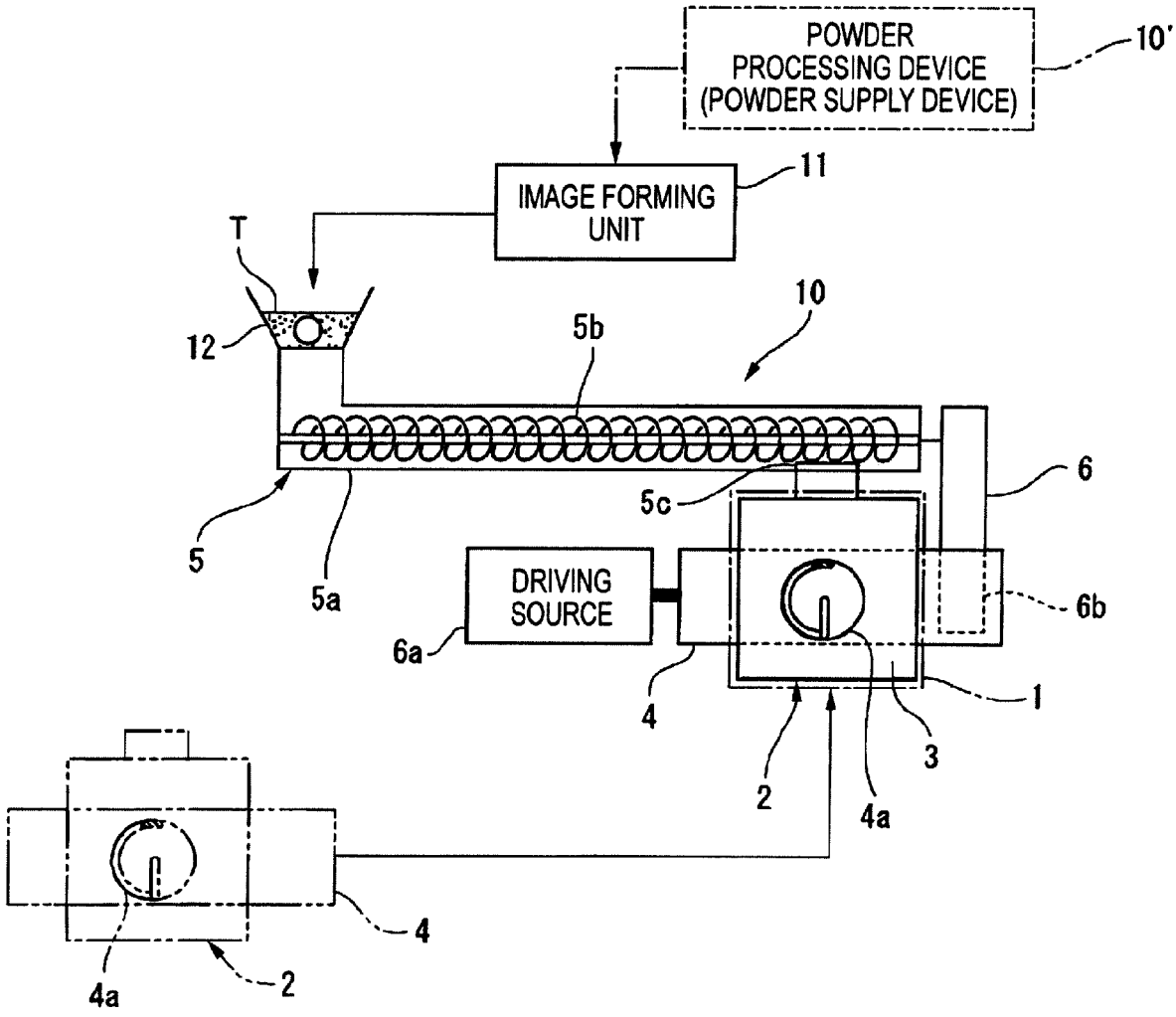
FIG. 2 is a diagram schematically showing an embodiment of an image forming apparatus using a powder processing device to which the invention is applied.

FIG. 2 shows an embodiment of an image forming apparatus using the powder processing device to which the invention is applied.

Referring to the figure, in an example where the powder processing device is applied as a powder recovery device, the image forming apparatus includes: an image forming unit 11 which forms an image by using an image forming material in the form of powder T; a cleaning unit 12 which cleans residual powder in the powder T used in the image forming unit 11; and the powder processing device (powder recovery device) 10 which recovers the powder T cleaned by the cleaning unit 12.

In an example where the powder processing device is applied as a powder supply device, the image forming apparatus includes: the image forming unit 11 which forms an image by using an image forming material in the form of powder T; and the powder processing device (powder supply device) 10' which supplies the powder T to be used in the image forming unit 11.

As the image forming unit 11, a unit of the electrophotographic system, the electrostatic recording system, or the like may be adequately selected as far as the unit can form an image by using an image forming material in the form of powder T. A unit which forms a monochrome image, that which forms a composite color images, or the like may be suitably selected as the image forming unit 11. With respect to the image forming process, the direct transfer system in which an image is directly transferred to a recording material, the intermediate transfer system in which an image is transferred to a recording material via an intermediate transferring member, or the like may be adequately selected.

The cleaning unit 12 may clean all of the residual powder T produced by the image forming unit 11, or may clean a part of the residual powder.

Hereinafter, the description will be made with exemplifying a powder recovery device as the powder processing device 10.

As shown in FIG. 2, the powder processing device 10 which is used in the embodiment is a powder processing device for processing the recovered powder T, and includes: the storage container 2 having the container body 3 which is detachably disposed on the predetermined container receiver 1, and in which the recovered powder T is stored, and the powder driving transmitting mechanism 4 which is disposed in the container body 3, and which transmits the transportable driving force to the powder T; the powder conveying mechanism 5 which is disposed on the side of the container receiver 1, which, outside the storage container 2, conveys the powder T along a conveying pipe 5*a*, and which, inside the conveying pipe 5*a*, has a conveying member 5*b* capable to convey the powder T; and the driving mechanism 6 which is disposed on the side of the container receiver 1 and outside the powder conveying mechanism 5, which, when the storage container 2 is mounted on the container receiver 1, is engaged with the powder driving transmitting mechanism 4, in a power transmittable manner, and which drives the conveying member 5*b* of the powder conveying mechanism 5 through the powder driving transmitting mechanism 4.

In such a technical configuration, the storage container 2 is requested to have at least a function of storing the powder T, and, in order to efficiently store the powder T in the storage container 2, it is preferable to move the powder T in the storage container 2 so as to level it.

In this case, in a mode where the storage container 2 itself is fixedly disposed on the container receiver 1, the conveying member 4*a* capable to convey the powder T into the storage container 2 may be disposed as an element of the powder driving transmitting mechanism 4, and, in a mode of the storage container 2 in which a swingable container body 3 is supported on a supporting frame, the container body 3 may be configured so as to be adequately swung.

The conveying pipe 5*a* of the powder conveying mechanism 5 is requested to convey the powder T, and often has a mode where one or plural supply ports for supplying the powder T thereinto are disposed. Usually, an opening/closing lid 5*c* is disposed in a connecting portion with respect to the storage container 2.

The driving mechanism 6 is requested to be disposed outside the conveying pipe 5*a*, but required to transmit the driving to the conveying member 5*b* which is in the inner side. In a mode where the driving transmission is performed, for example, from an end portion of the conveying member 5*b*, therefore, the driving mechanism 6 is disposed in a portion outside the conveying pipe 5*a* and corresponding to the end portion of the conveying member 5*b*.

The driving mechanism 6 is requested to, when the storage container 2 is mounted on the container receiver 1, be engaged with the powder driving transmitting mechanism 4 in a driving transmittable manner. Namely, the driving mechanism 6 is requested to transmit the driving force from a driving source 6*a* to the conveying member 5*b* in the conveying pipe 5*a* through the powder driving transmitting mechanism 4.

Next, preferred modes of components of the embodiment will be described.

In order to facilitate the conveyance of residual powder, a powder processing device which is used in a conventional image forming apparatus, such as a powder recovery device is often designed so that a powder conveying path partly includes a drop path through which powder is caused to drop by its own weight. Because of miniaturization and colorization of an image forming apparatus, however, it is difficult to ensure an installation space of the storage container 2 below the cleaning unit 12, and it is necessary to recover the powder T from a plurality of cleaning units 12 which cleans, for example, an intermediate transfer member. Therefore, there arises a situation where a toner conveying path for the powder T is correspondingly complicated.

Under such circumstances, it is difficult that the powder conveying path is provided with a drop path. In the conveying member 5*b* in the conveying pipe 5*a*, therefore, the path for forcedly conveying the powder T is prolonged. Because the powder conveying path is complicated, furthermore, it is necessary to form bent portions in the powder conveying path. Therefore, the number of coupling portions of conveying pipe components constituting the powder conveying path is inevitably increased, and there is a tendency that powder clogging easily occurs in the coupling portions.

This tendency is observed also in the powder supply device.

Because of such circumstances, from the viewpoint that the checking of powder clogging in the conveying pipe 5*a* is facilitated, preferably, the driving mechanism 6 is configured so that, when the storage container 2 is not mounted on the container receiver 1, at least a part of the driving mechanism is not engaged with the powder driving transmitting mechanism 4 and can be manually operated.

As a preferred mode of the powder driving transmitting mechanism 4 and the driving mechanism 6, there is a mode where a driving transmitting portion for the conveying member 4*a* which is an element of the powder driving transmitting mechanism 4 of the storage container 2 is disposed upstream from a driving transmitting portion for the conveying member 5*b* in the conveying pipe 5*a* of the powder conveying mechanism 5 in the direction of transmitting the driving force from the driving source 6*a* of the driving mechanism 6.

In this case, the positional relationship between the driving transmitting portion for the conveying member 4*a* of the storage container 2 and the driving transmitting portion for the conveying member 5*b* in the conveying pipe 5*a* of the powder conveying mechanism 5 is set so that the driving transmitting portion for the conveying member 4*a* of the storage container 2 in which the torque is higher is upstream in the direction of transmitting the driving force from the driving transmitting portion for the conveying member 5*b* in the conveying pipe 5*a* in which the torque is lower.

From the viewpoint of the driving transmission efficiency, it is preferable to configure the powder driving transmitting mechanism 4 so that the driving force from the driving source 6*a* of the driving mechanism 6 is directly supplied to the conveying member 4*a* of the storage container 2 through a coupling member or the like. Alternatively, a driving transmitting member such as an adequate number of gears may be interposed.

From the viewpoint that, during an operation of mounting the storage container 2 on the container receiver 1, the powder T is effectively prevented from overflowing the conveying pipe 5*a*, a mode is preferred where the driving mechanism 6 has a contacting/separating portion 6*b* which contacts with or separates from the powder driving transmitting mechanism 4 in accordance with mounting and dismounting of the storage container 2 on and from the container receiver 1, and, when the storage container 2 is mounted on the container receiver 1, the contacting/separating portion 6*b* is engaged with the powder driving transmitting mechanism 4 to be able to move the conveying member 5*b* in the conveying pipe 5*a* in a direction which is opposite to a normal driving direction.

As a preferred mode of the conveying pipe 5*a*, there is a mode where the conveying member 5*b* in the conveying pipe 5*a* is made of a material which is bendingly deformable in the direction of conveying the powder T, and the conveying pipe 5*a* has a bent portion on a side close to the driving mechanism 6.

In the mode, the bent portion of the conveying pipe 5*a* is requested to be close to the driving mechanism 6. When a bent portion in which the vertical direction component is changed is disposed, it is possible to effectively prevent the powder T in the conveying pipe 5*a* from overflowing during an operation of dismounting the storage container 2. Therefore, this is preferable.

In a preferred mode of the driving mechanism 6, from the viewpoint that damages of an end portion of the conveying member 5*b* are effectively suppressed in the conveying pipe 5*a*, the driving mechanism at least partly has a helical gear, and the helical angle of the helical gear is formed in a direction along which, when driven in a state where the driving mechanism is engaged with the powder driving transmitting mechanism 4, the conveying member 5*b* in the conveying pipe 5*a* is pressed into the conveying pipe.

In an image forming apparatus using the powder processing device 10, the conveying pipe 5*a* of the powder processing device 10 is preferably laid out so that the conveying pipe may be disposed at an arbitrary position (for example, the back surface side, the front side, or a lateral side) in the chassis of the image forming apparatus. In consideration of maintenance of the image forming unit 11 and the storage container 2, for example, the conveying pipe is preferably laid on the back face side of the chassis of the image forming apparatus.

Furthermore, preferably, the powder processing device 10 has the driving mechanism 6 in the downstream end in the direction of conveying the powder of the conveying pipe 5*a*, and the chassis of the image forming apparatus has an opening/closing door through which, in an opened state, the driving mechanism 6 is manually operable.

Hereinafter, the invention will be described in more detail on the basis of embodiments shown in the accompanying drawings.

Embodiment 1

—Whole Configuration of Image Forming Apparatus—

Figure 3:
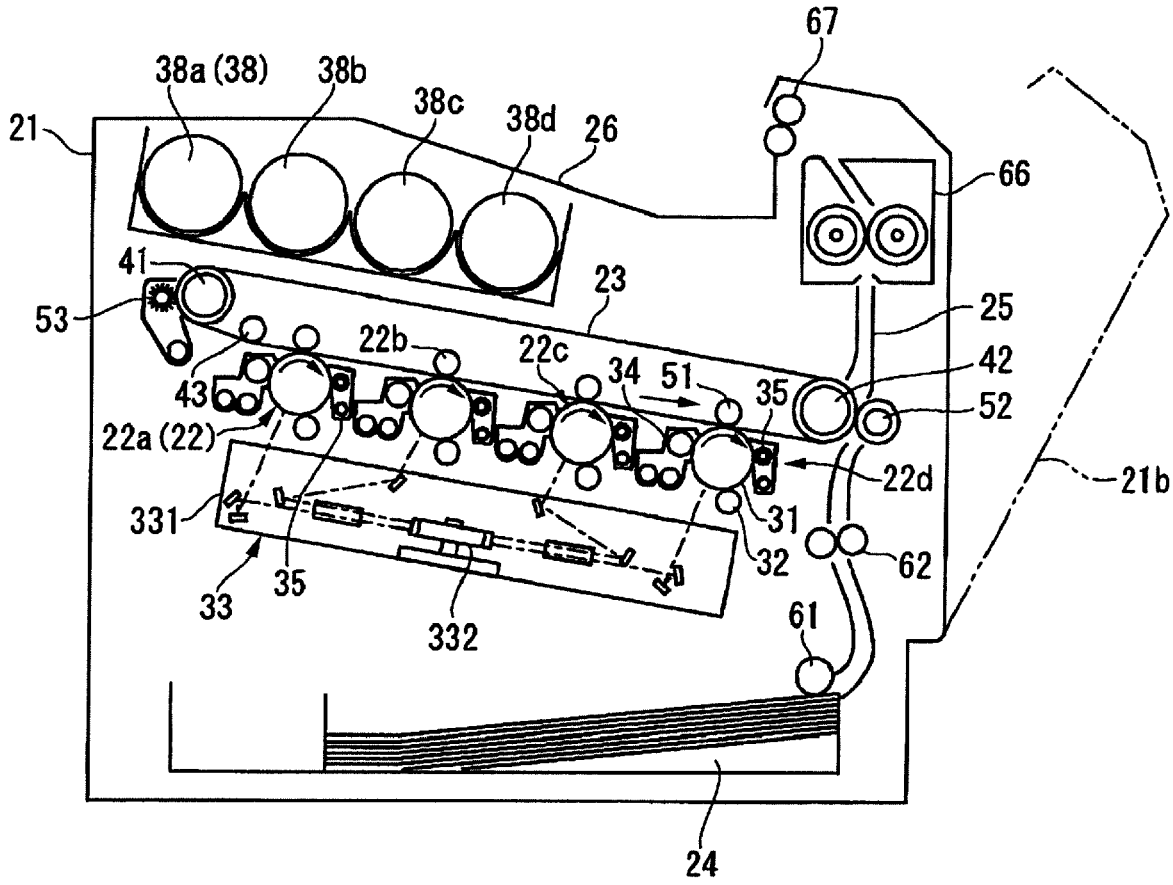
FIG. 3 is a diagram showing the whole configuration of the image forming apparatus of Embodiment 1.

FIG. 3 shows the whole configuration of Embodiment 1 of the image forming apparatus to which the invention is applied.

Referring to the figure, the image forming apparatus is configured so that image forming portions 22 (specifically, 22*a* to 22*d*) for four colors (in the embodiment, black, yellow, magenta, and cyan) are laterally arranged in the chassis of the image forming apparatus (hereinafter, referred to as the apparatus chassis) 21 in positional relationships in which the portions are slightly inclined obliquely upward, an intermediate transfer belt 23 which is circularly driven is disposed above and along the arrangement of the image forming portions 22, a recording material supplying device 24 which stores recording materials in a suppliable manner is disposed in a lower portion of the apparatus chassis 21, a recording material discharge tray 26 into which a recording material that has undergone image formation is discharged and stored is disposed in an upper portion of the apparatus chassis 21, and a recording material from the recording material supplying device 24 is discharged to the recording material discharge tray 26 through a recording material conveying path 25 which extends along the vertical direction.

Figure 4:
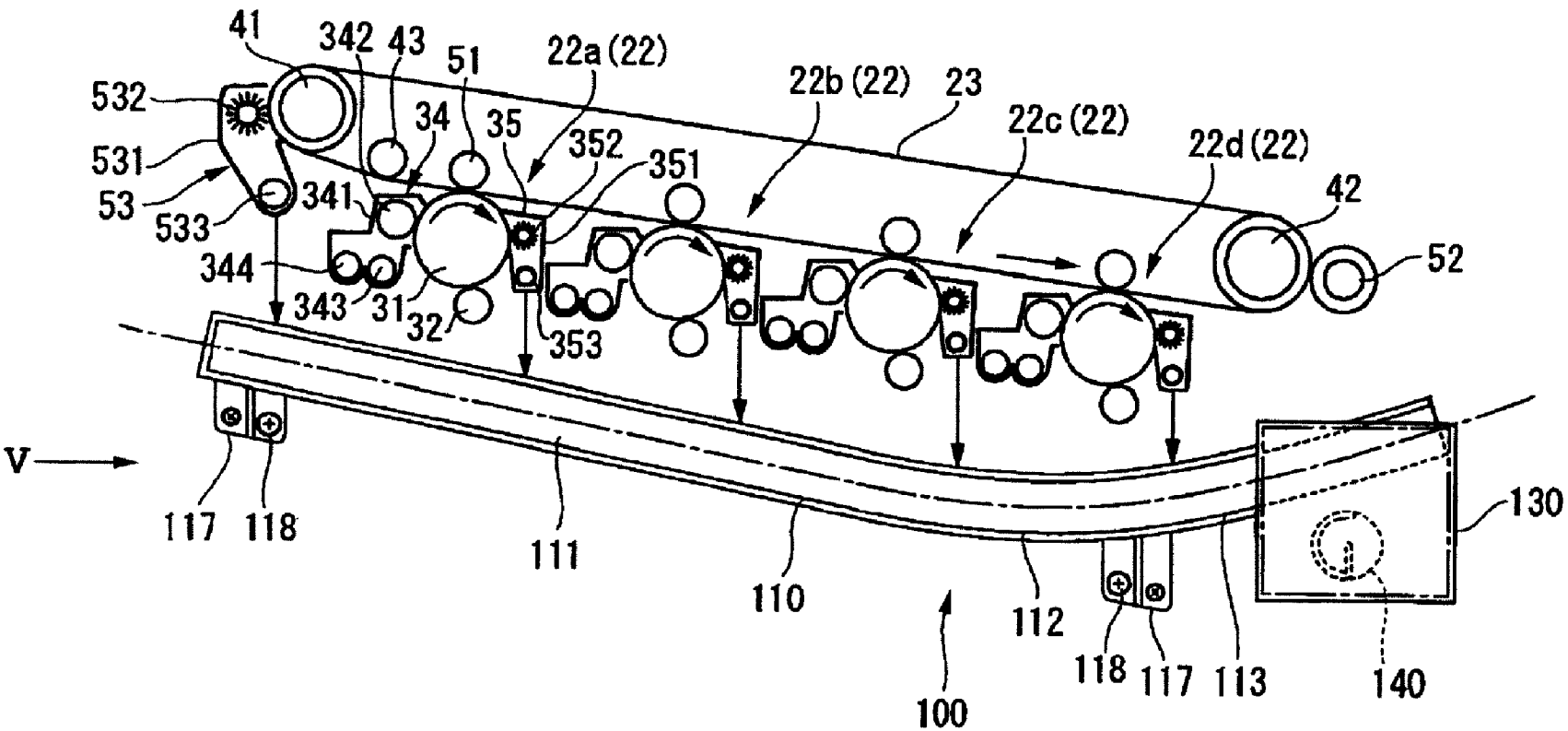
FIG. 4 is a diagram showing a powder recovery device used in Embodiment 1.

In the embodiment, as shown in FIGS. 3 and 4, in sequence starting from the upstream in the circulating direction of the intermediate transfer belt 23, the image forming portions 22 (22*a* to 22*d*) form toner images of yellow, magenta, cyan, and black (the arrangement is not restricted to this sequence). Each of the image forming portions includes: a photosensitive member 31 which is formed into a drum-like shape or the like; a charging device 32 which previously charges the photosensitive member 31; an exposing device 33 which writes an electrostatic latent image into the photosensitive member 31 that is charged by the charging device 32; a developing device 34 which visualizes the electrostatic latent image on the photosensitive member 31 by means of a toner of a corresponding color; and a cleaning device 35 which cleans a residual toner from the photosensitive member 31.

The exposing device 33 is used commonly in the image forming portions 22, and configured so that, in an exposure case 331, light beams from light sources such as semiconductor lasers (not shown) for respective color components are deflection-scanned by a deflection mirror 332 so that light images are guided to exposure positions on the respective photosensitive members 31, through imaging lenses and mirrors which are not shown.

As shown in FIG. 4, the developing device 34 has a developer container 341 which is opened toward the photosensitive member 31, and which stores a developer containing at least a toner. A developer holding member 342 which can convey the developer toward a developing region located in the position opposed to the photosensitive member 31 is disposed in the opening of the developer container 341. A pair of developer stirring and conveying members 343, 344 which can stir and convey the developer while circulating are disposed on the back of the developer holding member 342 of the developer container 341.

The cleaning device 35 has a cleaning container 351 in which the portion opposed to the photosensitive member 31 is opened. A cleaning member 352 such as a brush is disposed in a portion facing to the opening of the cleaning container 351. A leveling and conveying member 352 which levels residuals (powder) such as a toner that are scraped off by the cleaning member 352 is disposed in the cleaning container 351.

The intermediate transfer belt 23 is stretched around stretch rolls 41 to 43, and circularly moved by using, for example, the stretch roll 41 as a driving roll. A primary transferring device 51 (for example, a primary transfer roll) is disposed correspondingly with each of the photosensitive members 31, on the rear surface of the intermediate transfer belt 23. When a voltage having a polarity opposite to the charging polarity of the toner is applied to the primary transferring device 51, the toner image on the photosensitive member 31 is electrostatically transferred to the intermediate transfer belt 23.

A secondary transferring device 52 (for example, a secondary transfer roll) is disposed in a portion corresponding to the stretch roll 42 and downstream from the image forming portion 22*d* which is located most downstream in the moving direction of the intermediate transfer belt 23, and secondary-transfers (collectively transfers) the primary transfer images on the intermediate transfer belt 23.

An intermediate cleaning device 53 which cleans a residual toner on the intermediate transfer belt 23 is disposed in a portion of the intermediate transfer belt 23 corresponding to the stretch roll 41 which is downstream from the secondary transfer portion.

As the material of the intermediate transfer belt 23, a material in which an adequate amount of an antistatic agent such as carbon black is contained in a resin material such as polyimide, polycarbonate, polyester, or polypropylene, or various kinds of rubber is used. The intermediate transfer belt is formed so as to have a volume resistivity of $10^6$ to $10^{14}$ Ω·cm.

In a substantially similar manner as the cleaning device 35, also the intermediate cleaning device 53 includes a cleaning container 531, a cleaning member 532, and a leveling and conveying member 533.

In the embodiment, a recording member fed by a feeder 61 of the recording material supplying device 24 is conveyed by an adequate number of conveying rolls (not shown) in the recording material conveying path 25, registered by register rolls 62, and then passed through the secondary transfer portion of the secondary transferring device 52. The unfixed toner images are subjected to heating and pressurizing fixation by a fixing device 66. Thereafter, the recording member is discharged and accommodated in the recording material discharge tray 26 through discharging rolls 67.

In FIG. 3, the reference numeral 38 (38*a* to 38*d*) denotes developer storage containers (toner cartridges) which replenish the developing devices 34 of the image forming portions 22 (22*a* to 22*d*) with a fresh developer (in the embodiment, a toner).

—Powder Recovery Device—

In the embodiment, particularly, powders such as residual toners which are cleaned by the cleaning devices 35 of the image forming portions 22 (22*a* to 22*d*) and the intermediate cleaning device 53 are recovered into a powder recovery device 100 as shown in FIG. 4.

Referring to the figures, the powder recovery device 100 includes: a conveying pipe 110 which sequentially conveys powders in the cleaning devices 35 and the intermediate cleaning device 53; and a recovery container 130 which is disposed on one end side of the conveying pipe 110, and which recovers the powders conveyed along the conveying pipe 110.

—Conveying Pipe—

In the embodiment, as shown in FIGS. 5 to 7 and 9, the conveying pipe 110 is integrally configured by a resin material (e.g., an ABS resin) which can be formed so as to have, for example, a bent portion, and laterally placed on the back face side of the apparatus chassis 21 and correspondingly with lower positions of back-face end portions of the cleaning devices 35 of the image forming portions 22 (22*a* to 22*d*) and the intermediate cleaning device 53. The conveying pipe 110 may be formed by a material which is bendingly deformable (for example, a vinyl pipe).

The conveying pipe 110 has a linear portion 111 which corresponds to the intermediate cleaning device 53 and the cleaning devices of the image forming portions 22 (22*a* to 22*c*), and which is slightly inclined obliquely downward with respect to a horizontal posture, a bent portion 112 which is curvedly bent with respect to the linear portion 111 is formed in a portion corresponding to the cleaning device 35 of the image forming portion 22*d*, and a linear portion 113 which is slightly inclined obliquely upward is formed through the bent portion 112, so that the pipe has a flat U-like shape in which the lower side is convex.

Connecting portions 114 which correspond to the intermediate cleaning device 53 and the cleaning devices 35 of the image forming portions 22 (22*a* to 22*d*) are disposed in the upper wall of the conveying pipe 110. A powder supply port 115 is opened in each of the connecting portions 114, and a volumetric feeding mechanism 116 which can feed a constant quantity of powder is disposed in each of the powder supply ports 115.

Attaching pieces 117 are disposed in a part of the conveying pipe 110. The conveying pipe 110 is attached by fixing pieces 118 to a rear frame which is a part of the apparatus chassis 21, through the attaching pieces 117.

A discharge port 119 communicating with the recovery container 130 is disposed in a part of the lower wall of the linear portion 113 of the conveying pipe 110. A shutter 120 which is openable against the urging force of a spring that is not shown is disposed in a portion corresponding to the discharge port 119.

—Conveying Member—

Figure 6A:
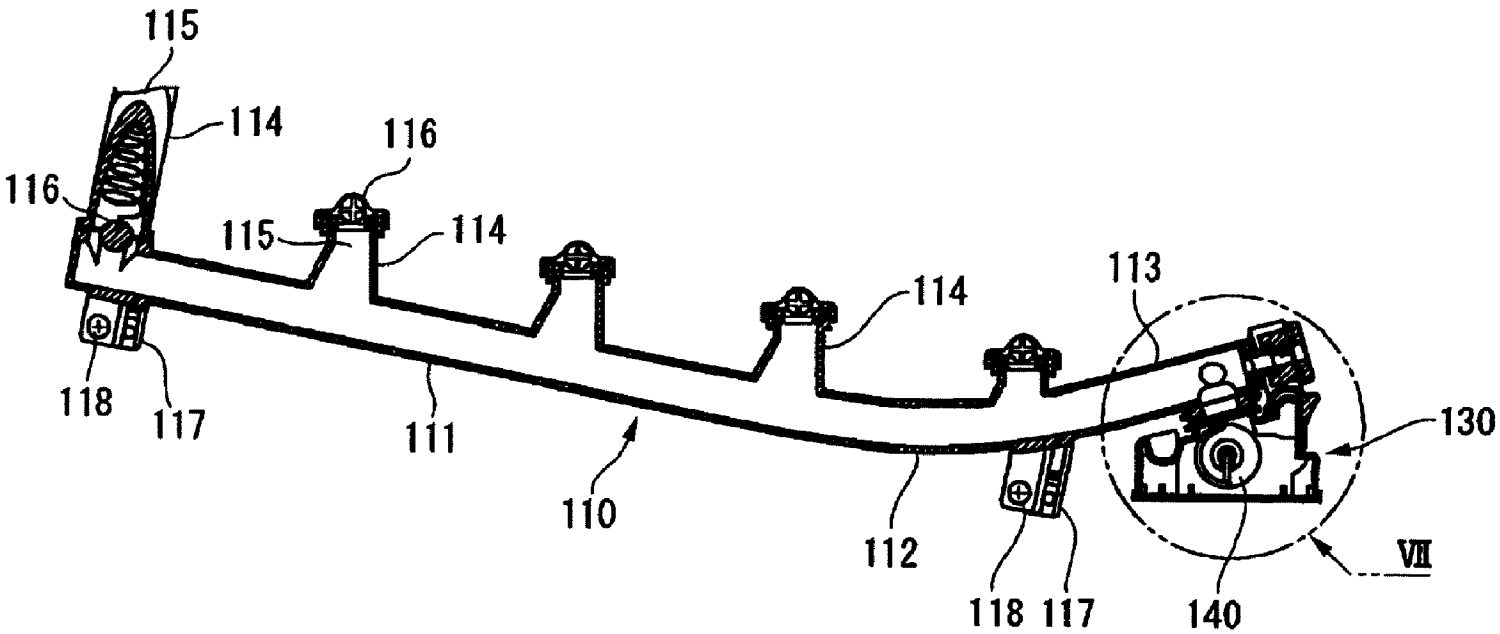
FIG. 6A is a view looking in direction VI-VI in FIG. 5.
Figure 6B:
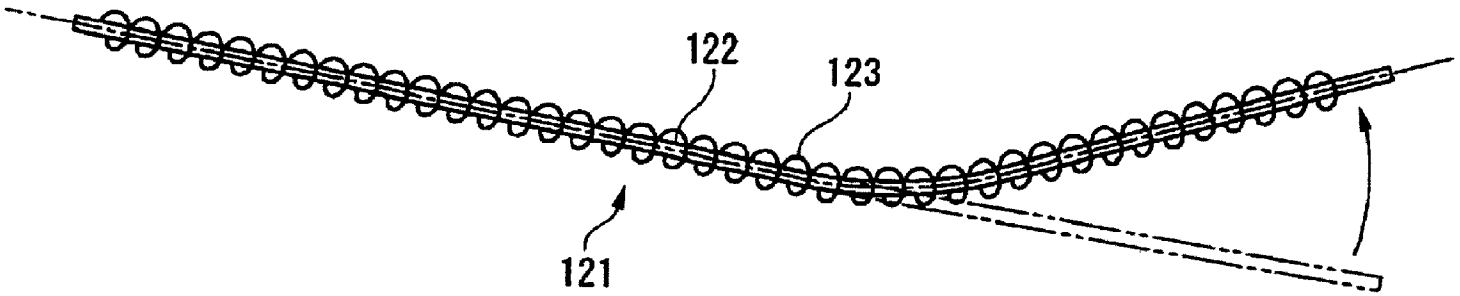
FIG. 6B is a diagram showing an example of a conveying member in a conveying pipe.

As shown in FIG. 6B, a conveying member 121 is disposed in the conveying pipe 110.

In the embodiment, the conveying member 121 is integrally formed by a resin material which is bendingly deformable (for example, POM, Nylon (registered trademark), PE, or PET), and has a rotation shaft 122 which linearly extends, and a vane portion 123 which is spirally formed in the periphery of the rotation shaft 122. An end portion of the rotation shaft 122 is supported in a cantilevered manner by a bearing member 124 disposed in one end portion of the conveying pipe 110. The conveying member is disposed in the conveying pipe 110 in a state where the conveying member is elastically bent and deformed along the bent shape of the conveying pipe 110.

—Recovery Container—

Figure 5:
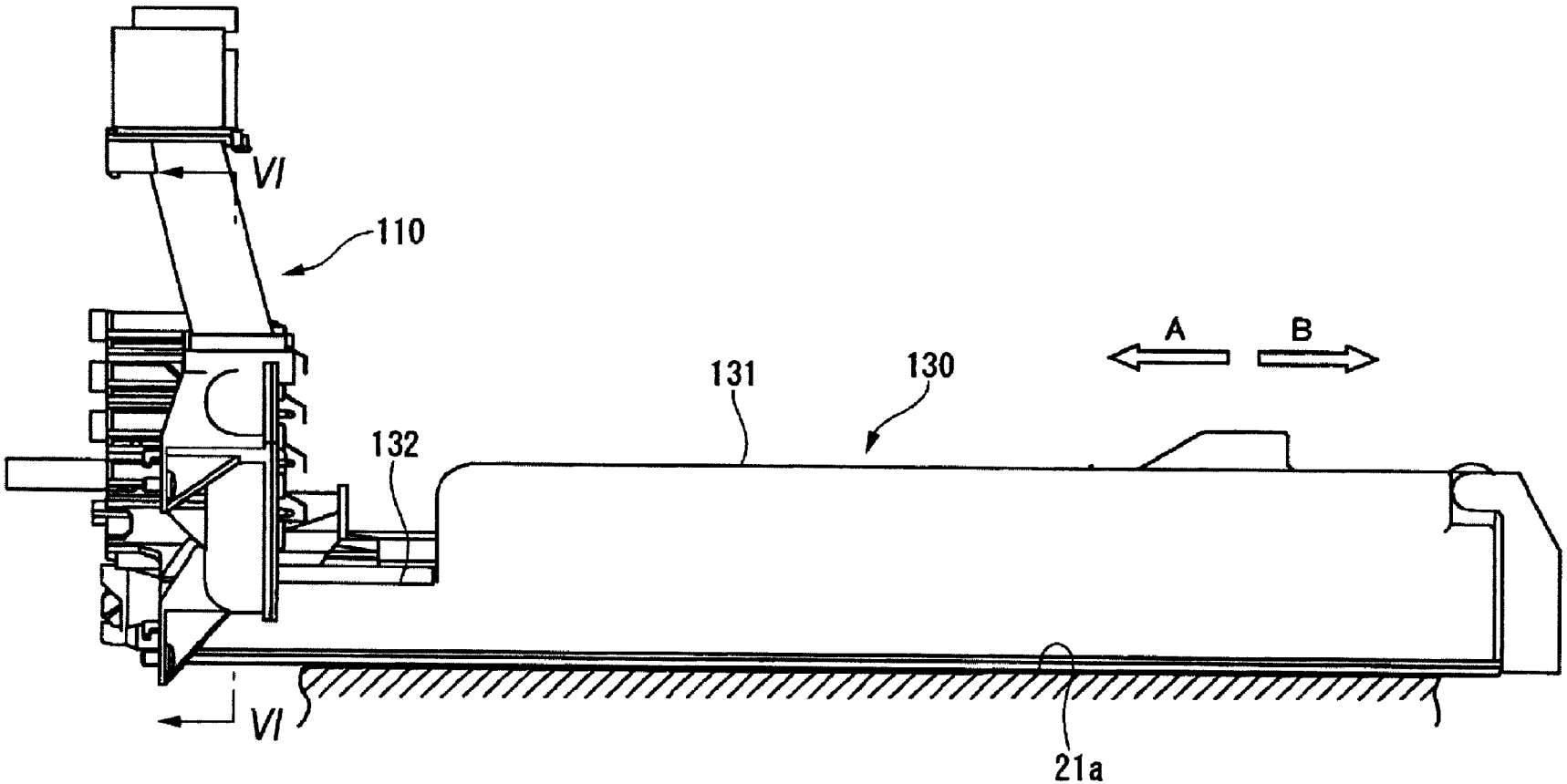
FIG. 5 is a view looking in direction V in FIG. 4.
Figure 7:
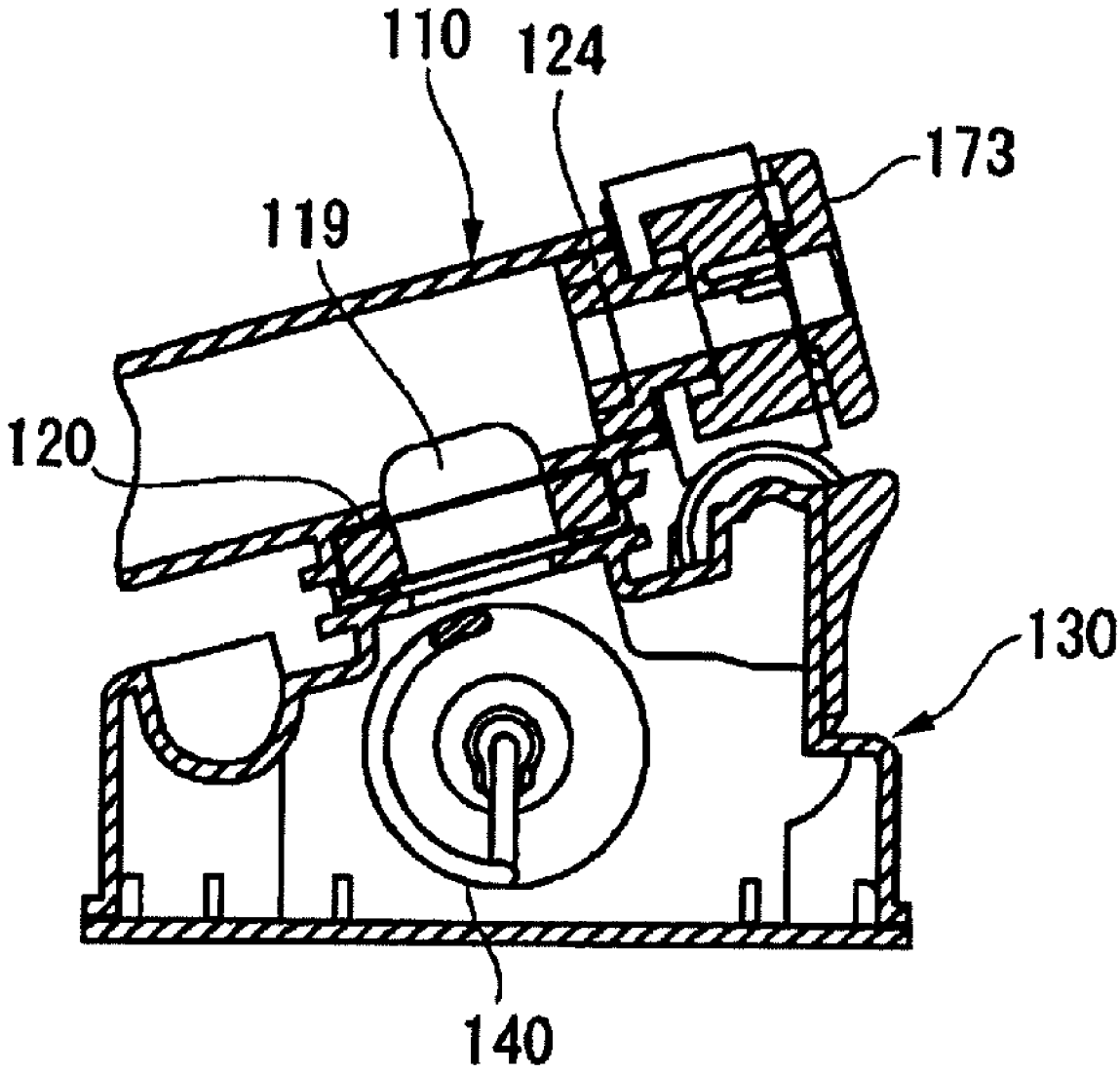
FIG. 7 is an enlarged partial view of portion VII in FIG. 6A.
Figure 8A:
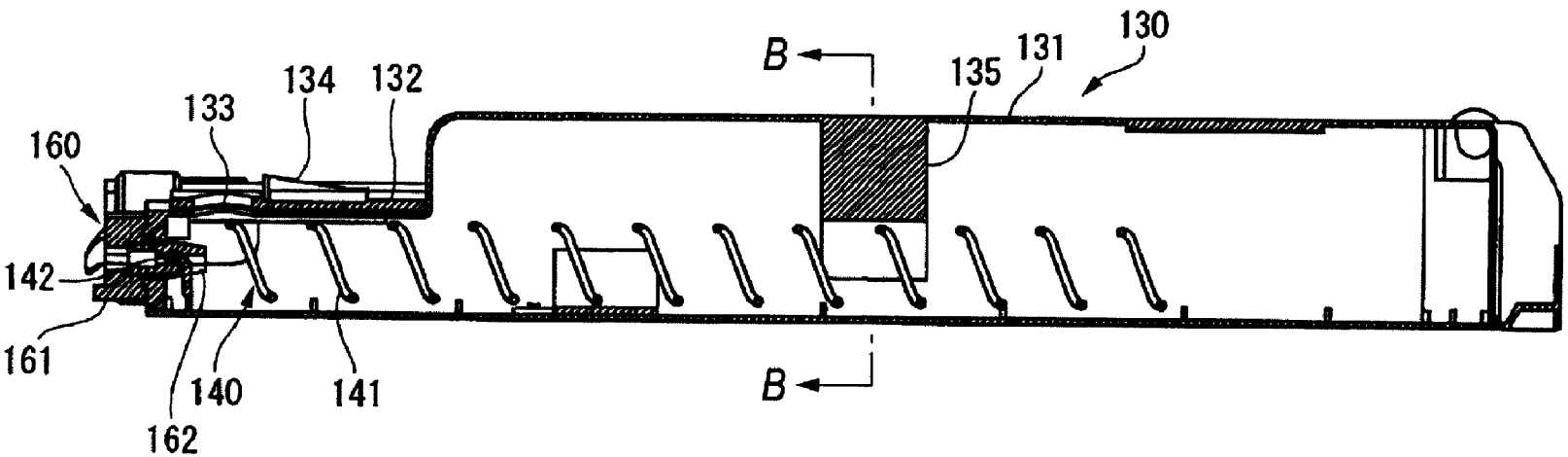
FIG. 8A is a longitudinal sectional view taken along the longitudinal direction of a recovery container.
Figure 8B:
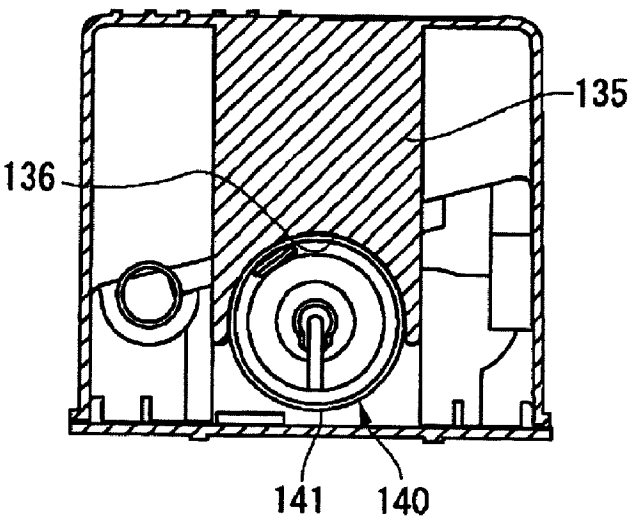
FIG. 8B is a sectional view taken along line B-B in FIG. 8A.
Figure 9:
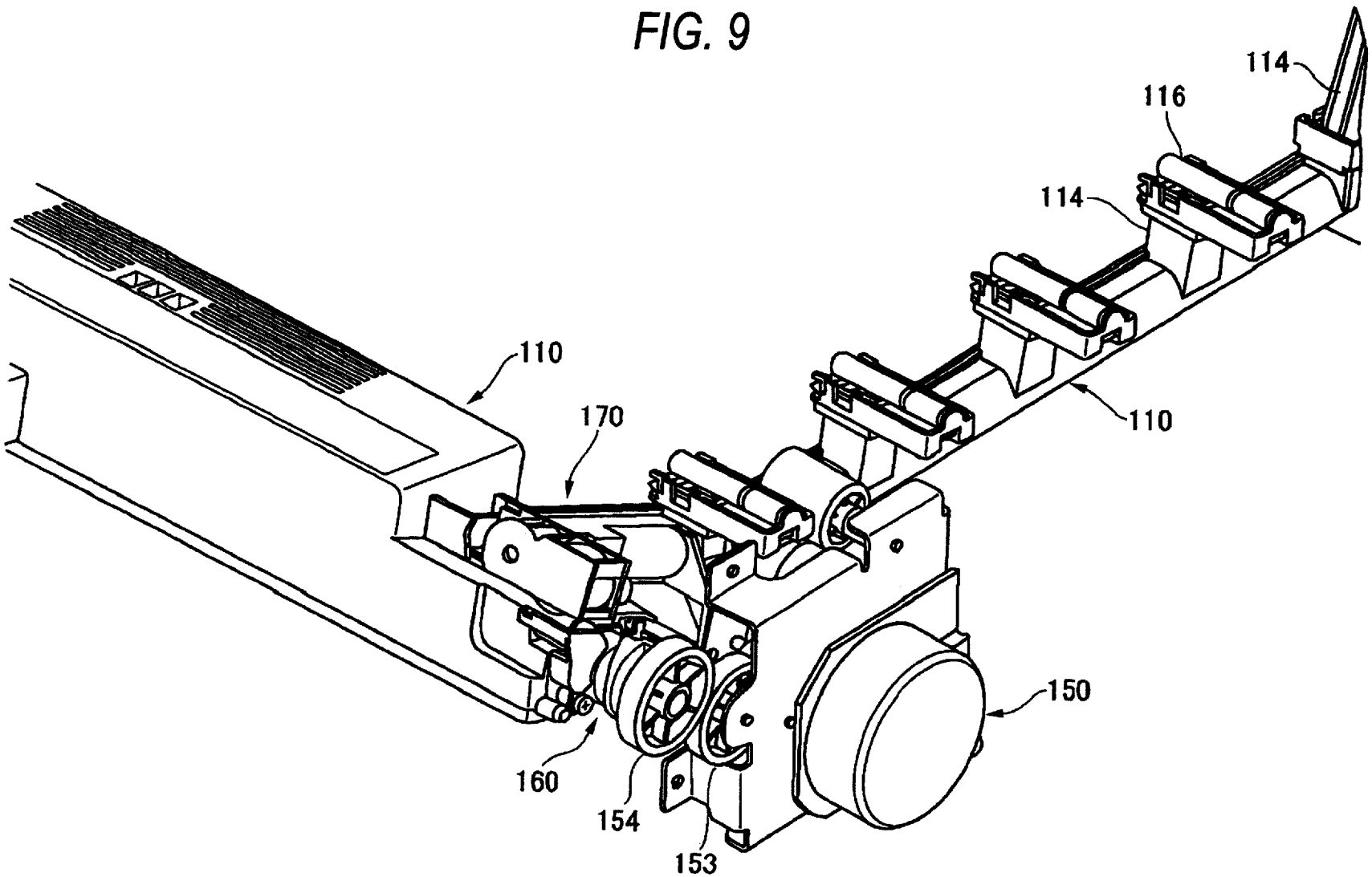
FIG. 9 is a perspective view showing in detail main portions of the powder recovery device used in Embodiment 1.

In the embodiment, as shown in FIGS. 5, 7, and 8, the recovery container 130 is disposed intersectingly with the conveying pipe 110 so as to be perpendicular thereto. When a front opening/closing door (not shown) of the apparatus chassis 21 is opened, the recovery container is inserted and mounted on a container receiver 21*a* in direction A (see FIG. 5) which is directed from the front side of the apparatus chassis 21 toward the back surface side, or conversely drawn out and dismounted in direction B (see FIG. 5) which is directed from the back surface side of the apparatus chassis 21 toward the front side.

The recovery container 130 is integrally configured by a resin material such as an ABS resin, and has a hollow box-like container body 131 for recovering powder. A recessed step portion 132 is formed in a portion of the container body 131 which intersects with the conveying pipe 110, and the intersecting portion of the conveying pipe 110 is put on the step portion 132.

A recovery port 133 is disposed on the step portion 132 of the recovery container 130. Also in the recovery port 133, a shutter 134 which is openable against the urging force of a spring that is not shown is disposed. When the recovery container 130 is mounted on the container receiver 21*a*, the shutter 134 is engaged with the shutter 120 of the conveying pipe 110. At the timing when the discharge port 119 of the conveying pipe 110 coincides with the recovery port 133 of the recovery container 130, the recovery port 133 is opened, and the shutter 120 is opened (see FIGS. 7 and 11).

—Conveying Member—

As shown in FIGS. 7 and 8, the recovery container 130 has a conveying member 140 which uniformly levels powder recovered into the container body 131.

The conveying member 140 is configured by a spirally linear member 141 which extends in the longitudinal direction of the container body 131. One end of the spirally linear member 141 is configured as a rotation shaft 142. The one-end rotation shaft 142 of the spirally linear member 141 is hooked and supported by a hook claw 162 of a coupling member 161 which is rotatably disposed in one longitudinal end of the container body 131.

The recovery container 130 has a pressing wall 135 which downward extends from the upper wall, in the vicinity of the longitudinal middle of the container body 131. A cutaway 136 which extends over an upper half of the spirally linear member 141, and which has a semicircular section shape is formed in a lower portion of the pressing wall 135 so that the disposition position of the spirally linear member 141 is regulated.

—Driving System of Powder Recovery Device—

As shown in FIGS. 9 to 12, the driving system of the powder recovery device 100 includes: a driving motor 150 which is fixed to the rear frame of the apparatus chassis 21; a recovery driving mechanism 160 in which the conveying member 140 of the recovery container 130 is driven by a driving force exerted by the driving motor 150; and a conveyance driving mechanism 170 which, when the recovery container 130 is mounted on the container receiver 21*a*, is engaged with the recovery driving mechanism 160 to drive the conveying member 121 in the conveying pipe 110 through the recovery driving mechanism 160.

<Driving motor>

Figure 12:
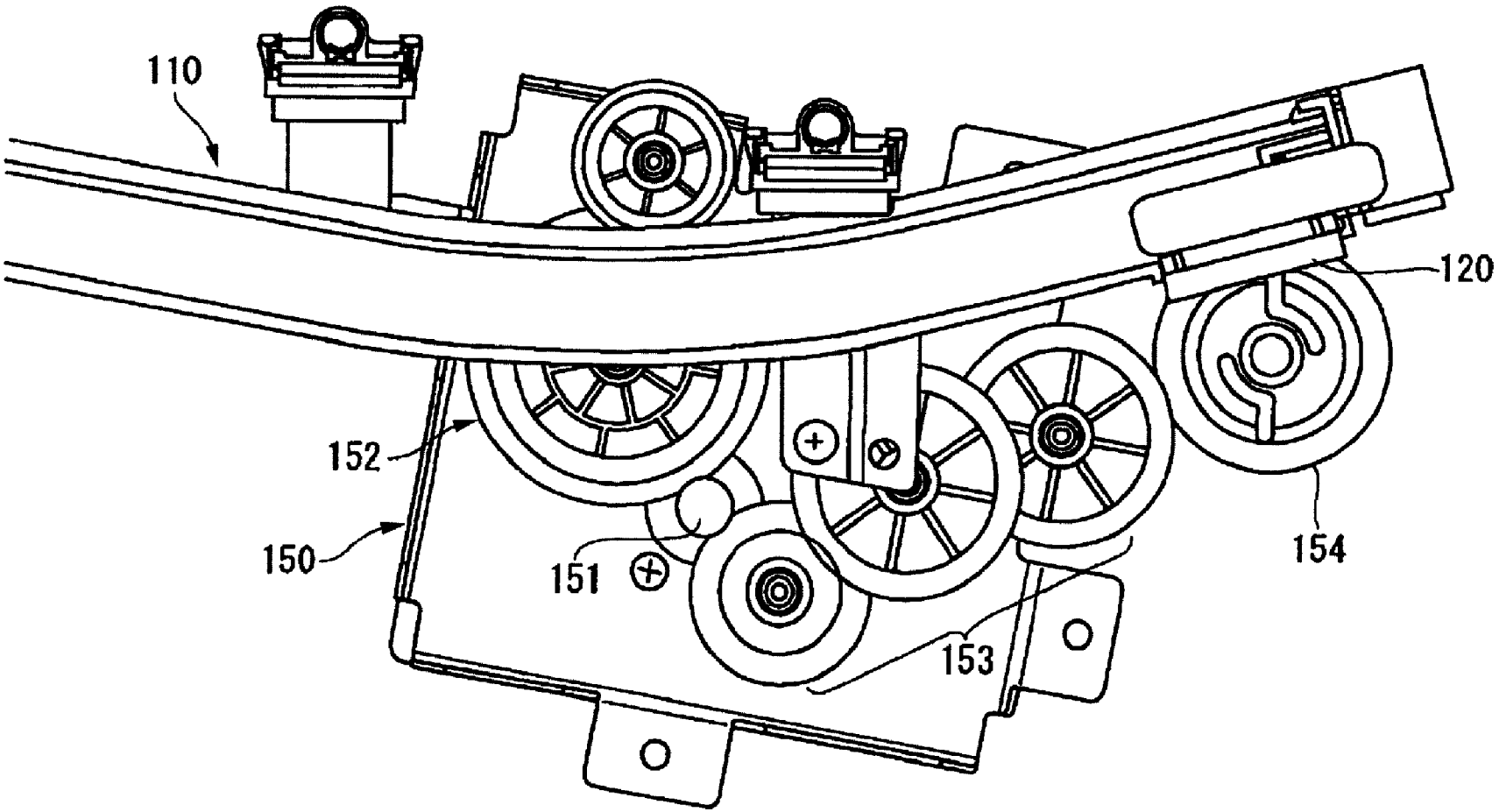
FIG. 12 is a view showing in detail a driving force transmitting mechanism from a driving source used in Embodiment 1.

In the embodiment, as shown in FIG. 12, the driving force of the driving motor 150 is used in, for example, the developing device 34 (see FIG. 3) of that image forming portion 22*d*, and also in the conveying member 140 of the recovery container 130. Specifically, a driving gear 151 is disposed coaxially with the shaft of the driving motor 150, a first driving transmission gear train 152 which extends toward the developing device 34 is disposed in the driving gear 151, a second driving transmission gear train 153 which extends toward the coupling member 161 of the conveying member 140 of the recovery container 130 is disposed, and a coupled member 154 which can be coupled with the coupling member 161 meshes with the final gear of the second driving transmission gear train 153.

<Recovery Driving Mechanism>

Figure 10:
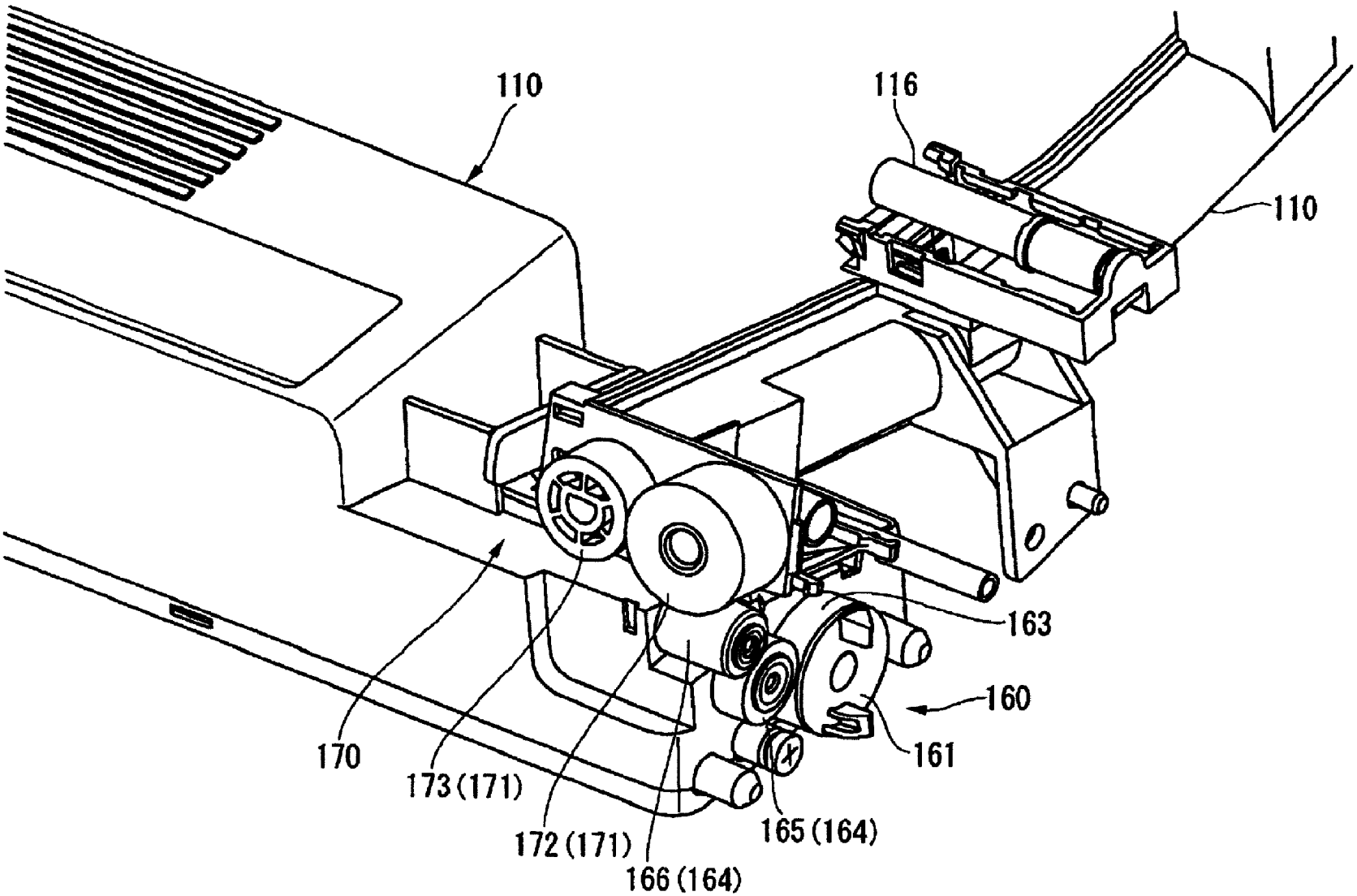
FIG. 10 is a view showing in detail a recovery driving mechanism for the recovery container used in Embodiment 1, and a conveyance driving mechanism for the conveying pipe.
Figure 11:
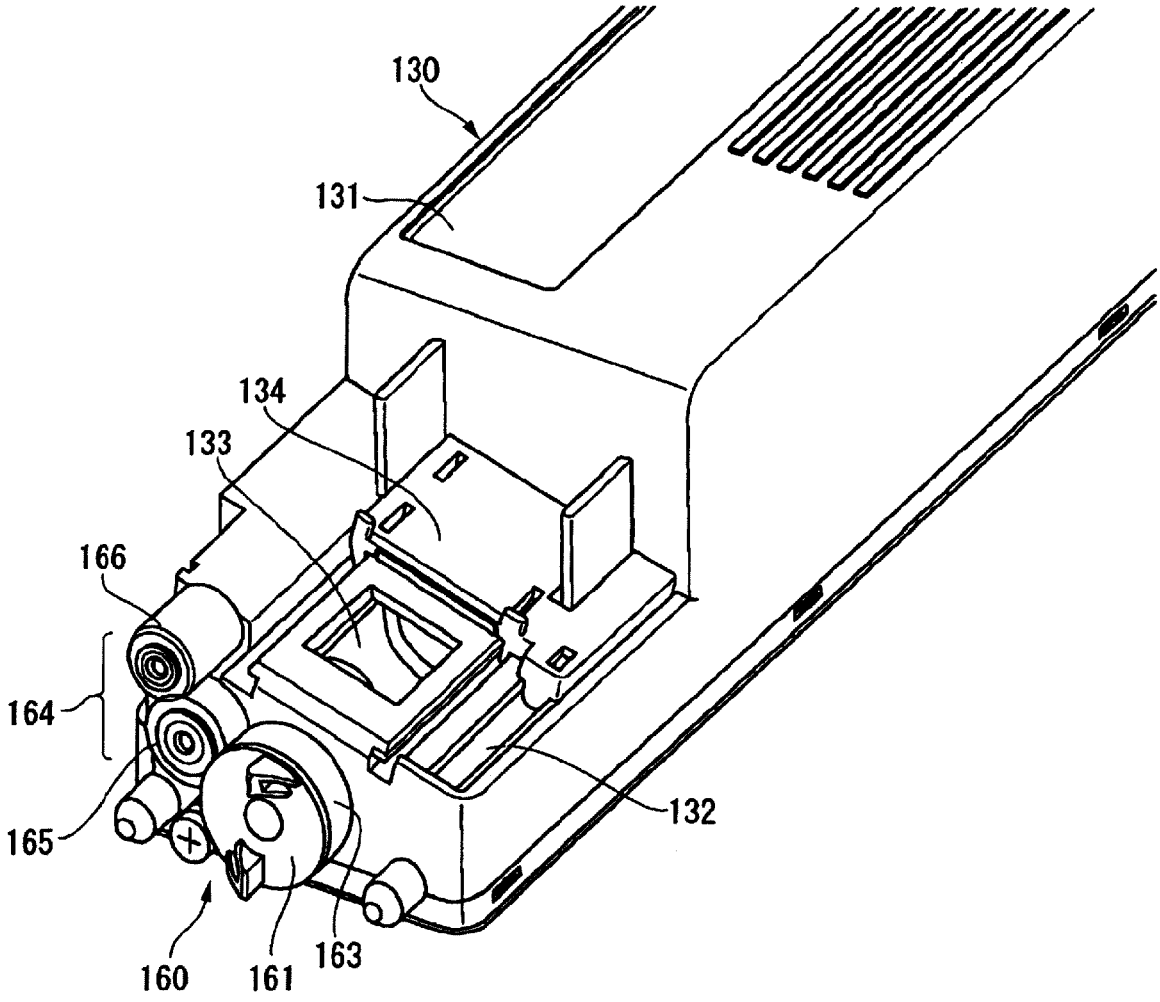
FIG. 11 is a view showing in detail a portion in which the recovery container used in Embodiment 1 is connected to the conveying pipe.

In the embodiment, as shown in FIGS. 8, 10, and 11, the recovery driving mechanism 160 includes: the coupling member 161 and hook claw 162 which are coupled to the rotation shaft 142 of the conveying member 140 in the recovery container 130; a gear portion 163 which is disposed in the periphery of the coupling member 161; and a driving transmission gear train 164 (specifically, driving transmission gears 165, 166) which meshes with the gear portion 163 to transmit the driving force.

In the embodiment, when the coupling member 161 is coupled to the coupled member 154 on the side of the driving motor 150, the recovery driving mechanism 160 drives the conveying member 140 of the recovery container 130.

<Conveyance Driving Mechanism>

In the embodiment, as shown in FIG. 10, the conveyance driving mechanism 170 has a driving transmission gear train 171 configured by a driving transmission gear 173 which is disposed coaxially with the rotation shaft 122 of the conveying member 121 of the conveying pipe 110, and a driving transmission gear 172 which meshes with the driving transmission gear 173. When the recovery container 130 is mounted on the container receiver 21*a*, the final gear 166 of the driving transmission gear train 164 of the recovery driving mechanism 160 is engaged with the driving transmission gear 172.

When the recovery container 130 is dismounted from the container receiver 21*a*, the engagement between the recovery driving mechanism 160 and the conveyance driving mechanism 170 is cancelled.

In the embodiment, particularly, the driving transmission gear train 171 of the conveyance driving mechanism 170 has driving transmission gears each of which is configured by a helical gear, and also the driving transmission gear train 164 of the recovery driving mechanism 160 has driving transmission gears each of which is configured by a helical gear. In the driving transmission gears each configured by a helical gear, the helical angle is adequately adjusted, so that the following behaviors are enabled.

(1) Measure for Preventing Powder Overflow

Figure 13A:
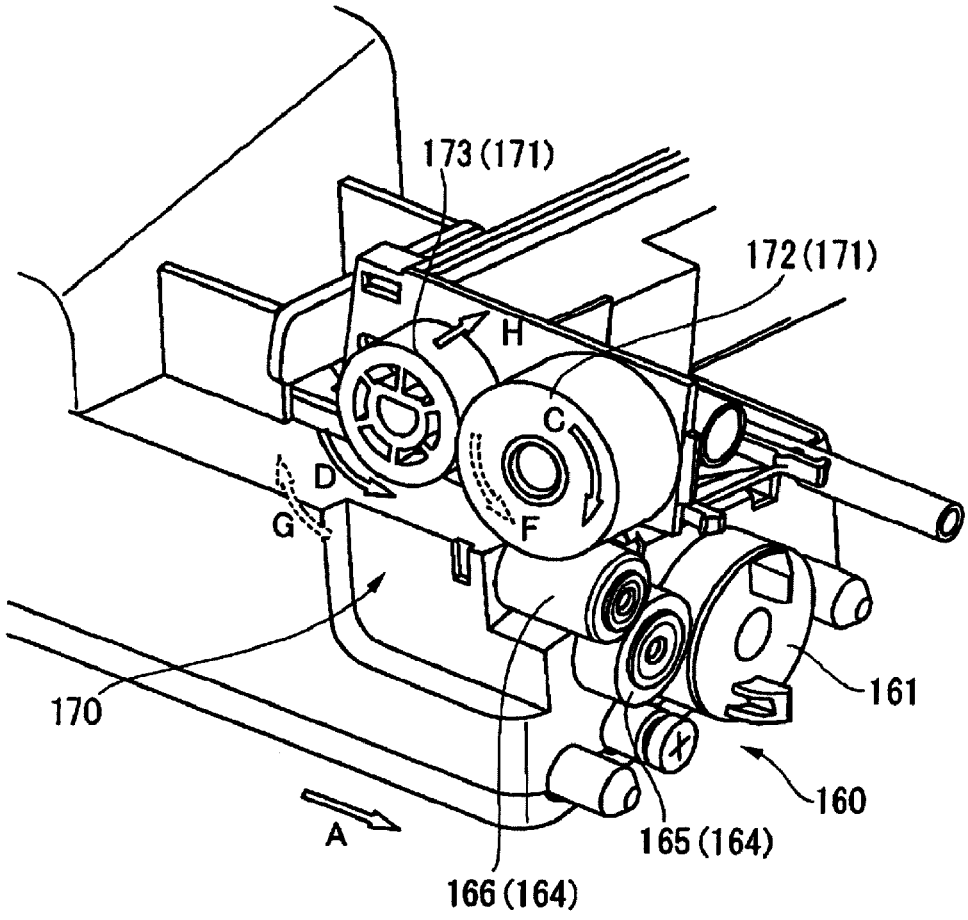
FIG. 13A is a view showing improvements of the conveyance driving mechanism used in Embodiment 1.

As shown in FIG. 13A, when, in an operation of mounting the recovery container 130 on the container receiver 21*a*, the recovery container 130 is inserted with respect to the container receiver 21*a* in the direction of arrow A, the final gear 166 of the driving transmission gear train 164 of the recovery driving mechanism 160 is engaged with the input-side driving transmission gear 173 of the driving transmission gear train 171 of the driving transmission gear 172. Therefore, the driving transmission gear 172 is rotated in the direction of arrow C, and the driving transmission gear 173 is rotated in the direction of arrow D (it is assumed that the rotation directions are opposite to those in the case of the driven state).

Figure 13B:
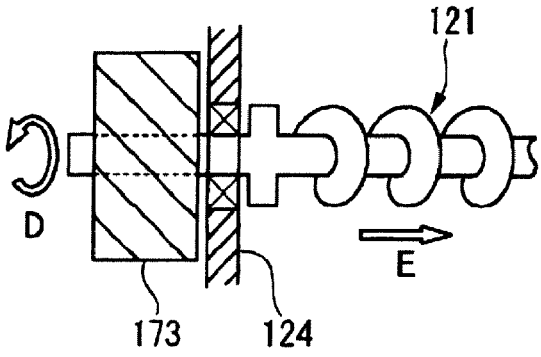
FIG. 13B is a diagram showing an operation process of the conveyance driving mechanism in the case where the recovery container is mounted on the container receiver.

At this time, as shown in FIG. 13B, the conveying member 121 of the conveying pipe 110 is rotated in the direction of arrow D, and the powder in the conveying pipe 110 is pressed back in the direction of arrow E in accordance with the rotation of the conveying member 121.

Even when powder exists in the vicinity of the discharge port 119 of the conveying pipe 110, therefore, the situation that the powder overflows the discharge port 119 can be effectively prevented from occurring by the powder pressing back operation performed by the conveying member 121.

In the embodiment, moreover, the conveying pipe 110 has the bent portion 112, and the linear portion 113 on the side of the recovery container 130 with respect to the bent portion 112 is placed while slightly inclined obliquely upward. Even when the recovery container 130 is dismounted from the container receiver 21*a*, therefore, the powder in the vicinity of the discharge port 119 of the conveying pipe 110 is returned toward the bent portion 112 by its own weight, and the possibility that powder unnecessarily drops from the discharge port 119 of the conveying pipe 110 is small.

(2) Measure for Suppressing Sliding Resistance of Conveying Member

Assuming that the recovery container 130 is mounted on the container receiver 21*a*, the conveying member 121 of the recovery container 130 is rotated through the coupling member 161 by the driving force of the driving motor 150.

By contrast, when the coupling member 161 is rotated in a predetermined direction during the driven state, the driving transmission gear train 164 is rotated in a predetermined direction in accordance with the rotation of the coupling member 161. As shown in FIG. 13A, the gears 172, 173 of the driving transmission gear train 171 of the conveyance driving mechanism 170 are rotated in the direction of arrows F and G, respectively, whereby the conveying member 121 of the conveying pipe 110 is rotated in the direction of arrow G.

At this time, the conveying member 121 of the conveying pipe 110 conveys powder in the conveying pipe 110 toward the recovery port 133 of the recovery container 130, and feeds the powder into the recovery container 130 through the discharge port 119 of the conveying pipe 110 and the recovery port 133.

In the conveyance driving operation, particularly, in the embodiment, the driving transmission gear train 171 is configured by helical gears, and the helical angle of each of the helical gears is set to a predetermined direction and a predetermined angle.

Figure 13C:
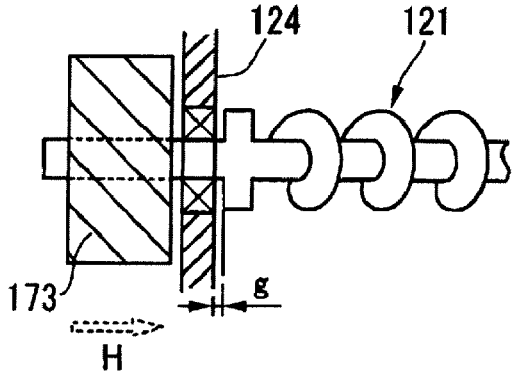
FIG. 13C is a diagram showing an operation process of the conveyance driving mechanism in a driven state.

In this state, as shown in FIG. 13C, the driving transmission gear train 171 which is configured by helical gears presses the conveying member 121 of the conveying pipe 110 in the pressing direction H, and hence a gap g is ensured between the conveying member 121 and the bearing member 124, so that the end portion of the conveying member 121 does not unnecessarily slide over the bearing member 124. Therefore, the sliding resistance between the conveying member 121 and the bearing member 124 can be correspondingly suppressed.

(3) Improvement of Driving Transmission Efficiency

In the embodiment, the conveying member 121 in the conveying pipe 110 is made of a material which is bendingly deformable, and the conveying pipe 110 has the bent portion 112 on the side close to the conveyance driving mechanism 170.

At this time, the conveying member 121 is elastically deformed to be strongly contacted with the inner surface of the bent portion 112 in the conveying pipe 110, and hence the sliding resistance between the conveying member 121 and the bent portion 112 of the conveying pipe 110 is larger than the sliding resistances of the other linear portions 111, 113 of the conveying pipe 110.

However, the conveyance driving mechanism 170 is disposed in the portion which is close to the bent portion 112, and hence the driving force from the conveyance driving mechanism 170 is easily transmitted to the portion of the conveying member 121 corresponding to the bent portion 112. Therefore, the performance of conveying powder in the bent portion 112 by the conveying member 121 can be satisfactorily ensured.

In the embodiment, moreover, the driving force from the driving motor 150 is transmitted to the conveying member 140 of the recovery container 130 in which the torque is higher, through the coupling member 161, and by contrast transmitted to the conveying member 121 in the conveying pipe 110 in which the torque is lower, through the gear portion 163 and the driving transmission gear train 164 of the recovery driving mechanism 160, and the driving transmission gear train 171 of the conveyance driving mechanism 170.

At this time, the driving transmitting portion for the conveying member 140 of the recovery container 130 is disposed upstream from that for the conveyance driving mechanism 170 in the direction of transmitting the driving force from the driving motor 150, and hence most of the driving force is distributed to the conveying member 140 which requires a higher torque.

—Operation of Mounting/Dismounting Recovery Container—

(1) When Recovery Container is Mounted

Figure 14:
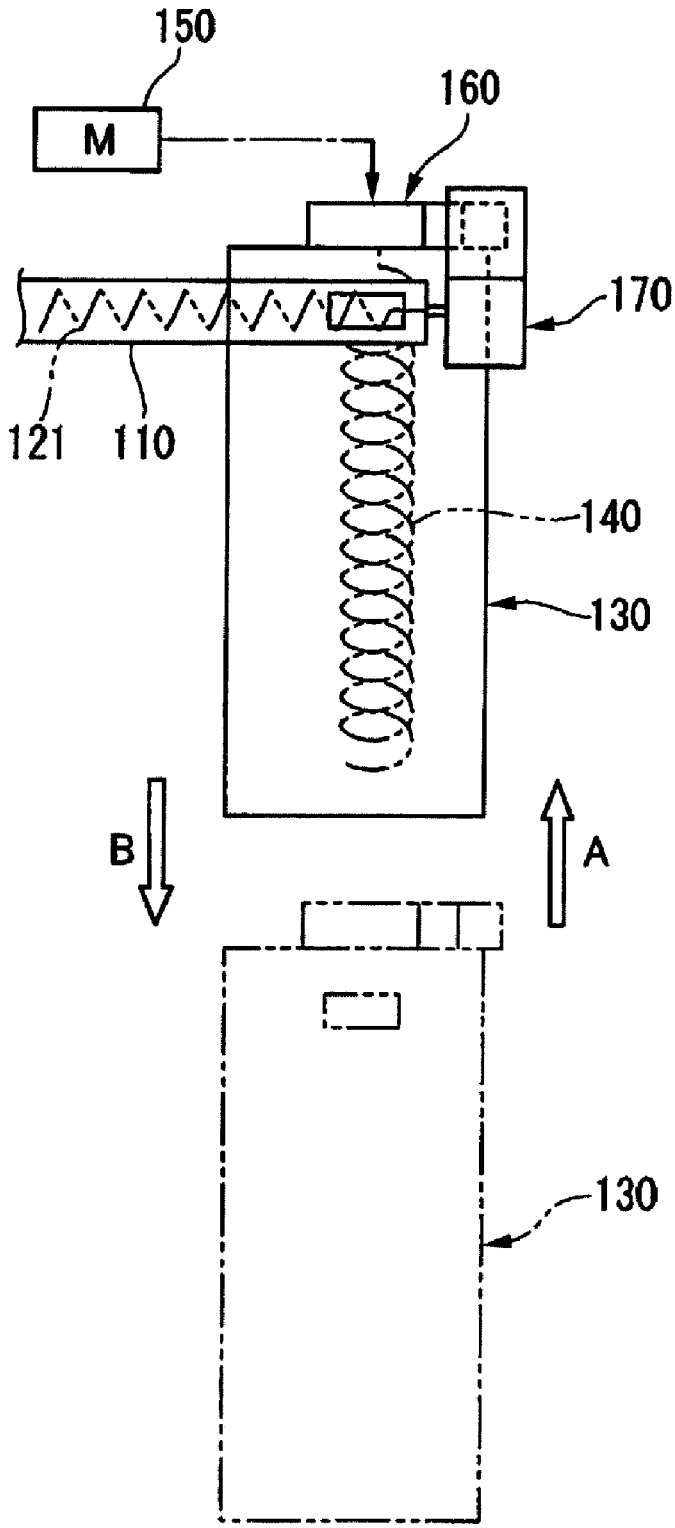
FIG. 14 is a diagram showing operation states in mounting and dismounting of the recovery container of the powder recovery device of Embodiment 1.

As shown in FIG. 14, when the recovery container 130 is mounted on the container receiver 21*a* in the direction of arrow A, the driving force exerted by the driving motor 150 is transmitted to the conveying member 140 of the recovery container 130 through the recovery driving mechanism 160. On the other hand, the driving force exerted by the driving motor 150 is transmitted to the conveying member 121 of the conveying pipe 110 through the recovery driving mechanism 160 and the conveyance driving mechanism 170.

(2) When Recovery Container is Dismounted

As shown in FIG. 14, when the recovery container 130 is drawn out and dismounted from the container receiver 21*a* in the direction of arrow B, the conveyance driving mechanism 170 of the conveying pipe 110 is not engaged with the recovery driving mechanism 160 on the side of the recovery container 130, and hence the driving force exerted by the driving motor 150 is not transmitted to the conveyance driving mechanism 170 inside the conveying pipe 110.

At this time, as shown in FIG. 3, an opening/closing door 21*b* is disposed on the side face of the apparatus chassis 21. When the opening/closing door 21*b* is opened, the user can manually operate the conveyance driving mechanism 170 of the conveying pipe 110 disposed on the back face side of the apparatus chassis 21, by using the opening of the opening/closing door 21*b*.

In this case, if it can be checked that, when the conveyance driving mechanism 170 is manually operated, the conveyance driving mechanism 170 is moved, it is known that powder clogging does not occur in the conveying pipe 110.

Conversely, if it can be checked that, even when the conveyance driving mechanism 170 is manually operated, the conveyance driving mechanism 170 is not moved, there is a possibility that powder clogging occurs in the conveying pipe 110.

Figure 15:
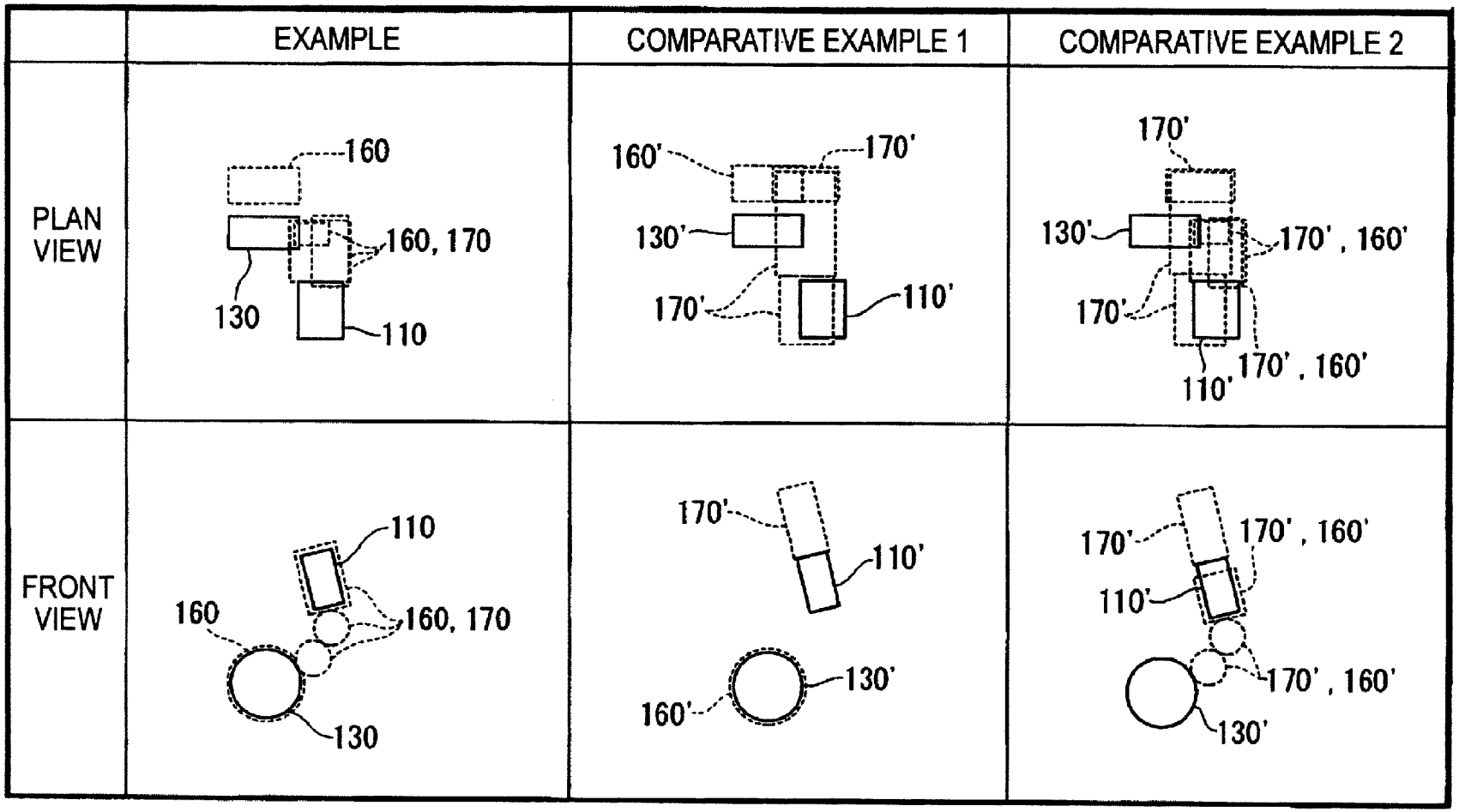
FIG. 15 is a view showing arrangement examples of Example and Comparative examples 1 and 2.

As shown in FIG. 15, next, the powder recovery device of the embodiment is set as an example, comparative examples 1 and 2 are produced as models which are different from the example, and their layouts are studied.

EXAMPLE

In the example, first, the conveying member (not shown) of the recovery container 130 is driven through the recovery driving mechanism 160, and the conveying member (not shown) of the conveying pipe 110 is driven through the recovery driving mechanism 160 and the conveyance driving mechanism 170.

Therefore, the recovery driving mechanism 160 and conveyance driving mechanism 170 for the two members are requested to be disposed so as to straddle the both of the conveying pipe 110 and the recovery container 130. It is known that the installation space for the mechanisms is not so bulky.

Comparative Example 1

Comparative example 1 is a model in which a conveying pipe 110' and a recovery container 130' are independently driven.

In the comparative example, a conveyance driving mechanism 170' (driving gears, transmission gears, and the like) must be disposed in a region above the conveying pipe 110', and hence the installation space for the conveyance driving mechanism 170' is bulky.

Comparative Example 2

In comparative example 2, a conveying member (not shown) of the conveying pipe 110' is directly driven, and a conveying member (not shown) of the recovery container 130' is driven through the conveyance driving mechanism 170' and a recovery driving mechanism 160'.

In the mode, the conveyance driving mechanism 170' for the conveying pipe 110' requires a direct driving element, and an indirect direct driving element for the recovery container 130'. As compared with the example, the recovery driving mechanism 160' and conveyance driving mechanism 170' for the both straddle the both of the conveying pipe 110' and the recovery container 130', and in addition the conveyance driving mechanism 170' must be disposed also above the conveying pipe 110'. Therefore, the installation space for the conveyance driving mechanism 170' is bulky.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A storage container comprising:

a container body that is detachably disposed on a predetermined container receiver, wherein powder to be supplied or recovered powder is stored in the container body; and a powder driving transmitting mechanism that is disposed in the container body, that is attachable to and detachable from the container receiver together with the container body, and that transmits a transportable driving force to the powder to be supplied or recovered powder, wherein the powder driving transmitting mechanism includes a conveying member which conveys the powder to be supplied or recovered powder inside the container body, when the container body is mounted on the container receiver, the powder driving transmitting mechanism couples a powder conveying mechanism with a driving mechanism and couples the conveying member with the driving mechanism, and the powder conveying mechanism is disposed on a side of the container receiver, and outside the container body, conveys the powder to be supplied or recovered powder, the driving mechanism is disposed on a side of the container receiver, and drives the powder conveying mechanism, and when the container body is mounted on the container receiver, a driving force is transmitted from the driving mechanism to the powder driving transmitting mechanism, and the powder driving transmitting mechanism transmits the driving force being distributed to the conveying member and the powder conveying mechanism.

2. The storage container according to claim 1, wherein the powder driving transmitting mechanism drives the conveying member by the driving force transmitted from the driving mechanism.

3. The powder processing device according to claim 2, wherein, in the powder driving transmitting mechanism, a driving transmitting portion for the conveying member of the storage container is disposed upstream from the driving transmitting portion for the conveying member of the powder conveying mechanism in a direction of transmitting the driving force from a driving source of the driving mechanism.

4. A powder processing device for processing powder to be supplied or recovered powder, comprising:

a storage container comprising:

a container body that is detachably disposed on a predetermined container receiver, wherein powder to be supplied or recovered powder is stored in the container body; and a powder driving transmitting mechanism that is disposed in the container body, that is attachable to and detachable from the container receiver together with the container body, and that transmits a transportable driving force to the powder to be supplied or recovered powder;

a powder conveying mechanism that is disposed on a side of the container receiver, that, outside the storage container, conveys the powder to be supplied or recovered powder along a conveying pipe, and that, inside the conveying pipe, has a conveying member capable to convey the powder; and a driving mechanism that is disposed on a side of the container receiver and outside the powder conveying mechanism, that, when the storage container is mounted on the container receiver, is engaged with the powder driving transmitting mechanism, in a power transmittable manner, and that drives the conveying member of the powder conveying mechanism powder driving transmitting mechanism the powder driving transmitting mechanism includes a conveying member which conveys the powder to be supplied or recovered powder inside the container body, when the container body is mounted on the container receiver, the powder driving transmitting mechanism couples the powder conveying mechanism with the driving mechanism and couples the conveying member of the powder driving transmitting mechanism with the driving mechanism, when the container body is mounted on the container receiver, the conveying member of the powder driving transmitting mechanism is driven on the basis of a driving force transmitted from the driving mechanism through the powder driving transmitting mechanism, and when the container body is mounted on the container receiver, the conveying member of the powder conveying mechanism is driven on the basis of a driving force transmitted from the driving mechanism through the powder driving transmitting mechanism and the powder conveying mechanism.

5. The powder processing device according to claim 4, wherein, when the storage container is not mounted on the container receiver, the driving mechanism is not engaged with the powder driving transmitting mechanism, and at least a part of the driving mechanism is manually operable.

6. The powder processing device according to claim 4, wherein, in the powder driving transmitting mechanism, a driving transmitting portion for the conveying member of the powder driving transmitting mechanism is disposed upstream from a driving transmitting portion for the conveying member of the powder conveying mechanism in a direction of transmitting the driving force from a driving source of the driving mechanism.

7. The powder processing device according to claim 4, wherein the driving mechanism comprises a contacting/separating portion which contacts with or separates from the powder driving transmitting mechanism in accordance with mounting and dismounting of the storage container on and from the container receiver, and, when the storage container is mounted on the container receiver, the contacting/separating portion is engaged with the powder driving transmitting mechanism to be able to move the conveying member of the powder conveying mechanism in a direction which is opposite to a normal driving direction.

8. The powder processing device according to claim 4, wherein the conveying member of the powder conveying mechanism is made from a material which is bendingly deformable in a direction of conveying the powder, and the conveying pipe has a bent portion on a side close to the driving mechanism.

9. The powder processing device according to claim 4, wherein the driving mechanism at least partly has a helical gear, and a helical angle of the helical gear is formed in a direction along which, when driven in a state where the driving mechanism is engaged with the powder driving transmitting mechanism, the conveying member of the powder conveying mechanism is pressed into the conveying pipe.

10. An image forming apparatus comprising:

an imaging unit which forms an image by using an image forming material in a form of powder;

a cleaning unit which cleans residual powder of the powder which is used in the imaging unit; and the powder processing device for recovering the powder cleaned by the cleaning unit, according to claim 4.

11. The image forming apparatus according to claim 10, wherein the powder processing device comprises a driving mechanism in a downstream end in a direction of conveying the powder of the conveying pipe of the powder conveying mechanism, and a chassis of the image forming apparatus comprises an opening/closing door through which, in an opened state, the driving mechanism is manually operable.

12. An image forming apparatus comprising:

an imaging unit which forms an image by using an image forming material in a form of powder; and the powder processing device for supplying powder to the imaging unit, according to claim 4.

* * * * *